US012084819B2

(12) United States Patent
McClelland et al.

(10) Patent No.: US 12,084,819 B2
(45) Date of Patent: Sep. 10, 2024

(54) BARRIER MEMBER

(71) Applicant: THREE SMITH GROUP LIMITED, Elland (GB)

(72) Inventors: Kallamm McClelland, Elland (GB); Lee Scothern, Elland (GB)

(73) Assignee: THREE SMITH GROUP LIMITED, Elland (GB)

( * ) Notice: Subject to any disclaimer, the term of this patent is extended or adjusted under 35 U.S.C. 154(b) by 524 days.

(21) Appl. No.: 17/380,222

(22) Filed: Jul. 20, 2021

(65) Prior Publication Data

US 2023/0019557 A1 Jan. 19, 2023

(30) Foreign Application Priority Data

Jul. 15, 2021 (GB) ..... 2110182

(51) Int. Cl.

| | |
|---|---|
| ***E01F 13/02*** | (2006.01) |
| ***E01F 13/04*** | (2006.01) |
| ***E01F 13/12*** | (2006.01) |
| ***E01F 15/14*** | (2006.01) |

(52) U.S. Cl.

CPC ..... *E01F 15/146* (2013.01); *E01F 13/028* (2013.01); *E01F 13/048* (2013.01); *E01F 13/12* (2013.01)

(58) Field of Classification Search

CPC ..... E06B 9/80; E06B 9/84; E06B 9/88; E06B 2009/807; E01F 15/148; E01F 13/028; E01F 13/04

USPC ..... 160/351, 242, 243, 246

See application file for complete search history.

(56) References Cited

U.S. PATENT DOCUMENTS

| | | | | |
|---|---|---|---|---|
| 116,929 A * | 7/1871 | Buckley | ..... | E06B 9/64 160/243 |
| 299,239 A * | 5/1884 | Massey | ..... | E06B 9/50 160/242 |
| 345,811 A * | 7/1886 | Simms | ..... | E06B 9/50 160/242 |

(Continued)

FOREIGN PATENT DOCUMENTS

| | | |
|---|---|---|
| CN | 1182805 A | 5/1998 |
| CN | 110273187 A | 9/2019 |

(Continued)

OTHER PUBLICATIONS

Jan. 11, 2022 Combined Search and Examination Report in British Application No. GB2110182.9.

(Continued)

*Primary Examiner* — Johnnie A. Shablack
(74) *Attorney, Agent, or Firm* — Oliff PLC

(57) ABSTRACT

A barrier member including: a support; a first engagement member coupled to the support; and a translatable column defining a longitudinal axis, wherein the translatable column is rotatably and translatably mounted relative to the support, wherein the translatable column is translatable between: a first position in which the translatable column and the first engagement member are spaced apart from one another such that the translatable column is rotatable about said longitudinal axis; and a second position in which the translatable column and the first engagement member are engaged to prevent rotation of the translatable column about said longitudinal axis.

21 Claims, 9 Drawing Sheets

(56) References Cited

U.S. PATENT DOCUMENTS 345,812 A * 7/1886 Simms ..... E06B 9/50 160/242
420,417 A * 1/1890 Simms ..... E06B 9/50 160/242
420,418 A * 1/1890 Simms ..... E06B 9/50 160/242
469,032 A * 2/1892 Simms ..... E06B 9/50 160/242
1,113,095 A * 10/1914 Bois ..... E06B 9/54 160/243
1,222,805 A * 4/1917 Schmid ..... A47B 23/042 211/180
1,459,789 A * 6/1923 Marsh ..... E06B 9/54 160/242
1,513,277 A * 10/1924 Sadowski ..... E06B 9/64 160/242
1,595,234 A * 8/1926 Kuyper ..... E06B 9/54 160/245
2,211,332 A 8/1940 Jones et al.
3,738,413 A 6/1973 Frobosilo et al.
3,882,921 A * 5/1975 Sandall ..... E06B 9/24 160/242
4,416,511 A * 11/1983 Weinberg ..... G03B 21/58 359/461
4,436,137 A * 3/1984 Charles ..... E06B 9/92 160/242
4,595,155 A * 6/1986 Gough ..... A63B 61/02 242/395.1
5,182,836 A 2/1993 Burkat
5,253,693 A * 10/1993 Marlatt ..... E06B 9/84 160/315
5,320,154 A * 6/1994 Colson ..... E06B 9/40 160/84.05
5,690,317 A * 11/1997 Sandsborg ..... E06B 9/08 160/300
5,862,851 A * 1/1999 Stoebich ..... E06B 9/58 160/246
5,871,038 A 2/1999 Gompertz et al.
6,056,038 A 5/2000 Foster et al.
6,059,007 A * 5/2000 Tomita ..... E06B 9/54 160/264
6,142,701 A * 11/2000 Falcon ..... E01F 13/028 404/9
6,575,435 B1 6/2003 Kotzen
6,814,127 B2 * 11/2004 Tagtow ..... E06B 9/54 160/31
6,863,235 B2 3/2005 Koning et al.
7,134,473 B2 * 11/2006 Lukos ..... E06B 9/50 160/242
7,207,370 B2 4/2007 Snyder et al.
7,219,709 B1 * 5/2007 Williams ..... E01F 13/028 160/24
7,237,591 B2 7/2007 Snyder et al.
7,337,882 B2 3/2008 Geyer
7,549,615 B2 * 6/2009 Shevick ..... E06B 9/323 248/200.1
7,669,634 B2 * 3/2010 Sugiyama ..... E06B 9/54 242/384.7
7,770,625 B2 * 8/2010 Lukos ..... G03B 21/58 160/242
7,810,544 B2 * 10/2010 Spiess ..... B66B 13/305 160/242
8,087,443 B2 * 1/2012 Snyder ..... E01F 13/028 160/242
8,162,292 B2 * 4/2012 Farmer ..... E04H 17/004 160/242
8,220,520 B2 * 7/2012 Lukos ..... G03B 21/58 160/242
8,261,806 B2 * 9/2012 Wettern ..... E01F 13/028 160/24
8,267,146 B2 * 9/2012 Frede ..... E06B 9/62 160/238
8,500,360 B1 * 8/2013 Jones ..... E01F 9/70 404/9
9,714,491 B2 * 7/2017 Wettern ..... E01F 13/022
11,105,148 B2 * 8/2021 Shipman ..... E06B 9/42
2005/0098770 A1 * 5/2005 Schell ..... E01F 13/028 256/25
2005/0220537 A1 * 10/2005 Bentley ..... E01F 13/028 404/9
2006/0090860 A1 * 5/2006 Corboy ..... A62C 2/24 160/133
2007/0176158 A1 * 8/2007 Robinson ..... E01F 13/028 256/12.5
2008/0121352 A1 * 5/2008 Cheng ..... E06B 9/08 160/238
2008/0121354 A1 5/2008 Cheng
2009/0008042 A1 * 1/2009 Snyder ..... E01F 13/028 160/264
2010/0288450 A1 * 11/2010 Bruck ..... F16M 11/242 248/176.1
2010/0301296 A1 * 12/2010 Ratzenberger ..... E01F 13/028 256/24
2012/0061032 A1 * 3/2012 Snyder ..... E01F 13/028 160/310
2012/0075731 A1 3/2012 Iikawa et al.
2012/0256149 A1 * 10/2012 Sylvester ..... E01F 13/028 256/73
2014/0014760 A1 * 1/2014 Tsai ..... E01F 13/028 242/396
2015/0041075 A1 * 2/2015 Henderson ..... E06B 9/08 242/382.5
2018/0044868 A1 * 2/2018 Miller ..... E01F 13/028
2019/0063018 A1 * 2/2019 Reiner ..... B65H 75/4471
2022/0056651 A1 * 2/2022 Liang ..... E06B 9/90
2023/0019557 A1 * 1/2023 McClelland ..... E01F 13/028
2023/0295985 A1 * 9/2023 Smith ..... E06B 9/54 160/323.1

FOREIGN PATENT DOCUMENTS

CN 110747518 A 2/2020
EP 1448856 B1 8/2007
EP 1860344 A1 11/2007
KR 20080008906 A 1/2008
SU 1548061 A2 3/1990
UA 26864 U 10/2007
UA 38902 U 1/2009
WO WO-9713049 A1 * 4/1997 ..... A01K 1/0017
WO 2009/009435 A2 1/2009
WO 2010/044062 A1 4/2010
WO 2021/035152 A1 2/2021

OTHER PUBLICATIONS

Oct. 6, 2022 Search Report issued in International Patent Application No. PCT/GB2022/051789.

* cited by examiner

BARRIER MEMBER

The present disclosure relates to a barrier member, and in particular to a barrier member including a translatable column.

BACKGROUND

It is known to provide barriers and gates to protect equipment and demarcate areas. Such barriers and gates may be used to demarcate a path for pedestrians or motorists and/or prevent a vehicle colliding with equipment which can, for instance, cause damage to the equipment.

Barriers may be used to bring vehicles, such as forklift trucks to a stop to prevent them from driving into equipment or driving off a ledge. This is particularly important in relation to loading bay areas in which a steep drop may be present.

It is a challenge to provide a barrier that is sufficient to bring vehicles to a halt without imparting a high inertial impact on a driver.

It is an aim of the present invention to attempt to overcome at least one of the above or other disadvantages

SUMMARY

According to the present disclosure there is provided a barrier member and method as set forth in the appended claims. Other features of the invention will be apparent from the dependent claims, and the description which follows.

According to a first aspect, there is provided a barrier member comprising: a support; a first engagement member coupled to the support; and a translatable column defining a longitudinal axis, wherein the translatable column is rotatably and translatably mounted relative to the support, wherein the translatable column is translatable between: a first position in which the translatable column and the first engagement member are spaced apart from one another such that the translatable column is rotatable about said longitudinal axis; and a second position in which the translatable column and the first engagement member are engaged to prevent rotation of the translatable column about said longitudinal axis.

The barrier member set out above is suitable for being used in a barrier system to absorb a vehicle impact and provide a cushioned deceleration to the vehicle, thereby reducing the likelihood of injury to a vehicle operator, whilst also prioritising safety. The barrier member allows for steady deceleration of vehicle under impact resulting in smaller forces exerted on the driver and so lowers the risks of injury. the barrier member will absorb multiple impacts and multiple products can be linked together to protect a larger area.

The translatable column may comprise a second engagement member having a complimentary shape with the first engagement member, such that in the second position, the second engagement member is configured to engage with the first engagement member to prevent rotation of the translatable column.

Providing a second engagement member (or one or more second engagement members) that has a complimentary shape provides means for preventing the translatable column from rotating. The barrier member may include one or more first engagement members.

A flexible barrier material may extend from the translatable column in a direction substantially perpendicular to said longitudinal axis. The flexible barrier material is configured to be coupled to a connection point.

The barrier member may be configured such that: in a first mode of operation, the translatable column is operable to rotate around the longitudinal axis in a first rotational direction to wind the flexible barrier material onto the column; and in a second mode of operation, the translatable column is operable to rotate around the longitudinal axis in a second rotational direction to unwind the flexible barrier material from the column; and in a third mode of operation, the translatable column is operable to move from the first position to the second position.

The barrier member may be configured to switch between the second mode of operation and the third mode of operation if an impact force on the flexible barrier material is above a first threshold value.

The support may comprise a housing configured to house the translatable column and first engagement member, wherein the housing comprises a slot through which the flexible barrier material is configured to extend, in use.

The barrier member may comprise one or more biasing members configured to bias the translatable column to the first position.

The one or more biasing members is configured to compress as the translatable column is moved from the first position to the second position.

One or more biasing members may comprise one or more hydraulic buffers. One or more hydraulic buffers may comprise one or more first hydraulic buffers having a first load response characteristic and one or more second hydraulic buffers having a second, different load response characteristic arranged in series.

The one or more biasing members may comprise a compressible elastic material.

The one or more biasing members comprises a plurality of magnets configured to bias the translatable column to the first position.

The one or more biasing members may comprise one or more springs.

The one or more springs comprises one or more first springs having a first stiffness and one or more second springs having a second, different stiffness arranged in series.

The support may comprise a first movement mechanism defining the extent of translation of the translatable column, the first movement mechanism comprising a first end member and a second end member and the one or more biasing members, wherein the one or more biasing members are located between the first end member and the second end member.

The first end member of the movement mechanism may be coupled with an inner surface of the housing at a first location and the second end member of the movement mechanism may be coupled with an inner surface of the housing at a second location, wherein the first location and second location are diametrically opposed on the housing.

The first movement mechanism may comprise one or more guiderails extending between the first end member and the second end member of the movement mechanism, wherein the translatable column is coupled to the one or more guiderails via a column attachment block.

The first engagement member may be coupled to the one or more guide rails.

The one or more first springs may be located between the first engagement member and the column attachment block and the one or more second springs may be located between a second end member of the movement mechanism and the first engagement member.

The one or more second springs comprises a higher stiffness than the one or more first springs.

The support may comprise a second movement mechanism, wherein the first movement mechanism and second movement mechanism are arranged at opposite ends of the support.

According to one aspect, there is provided a barrier comprising: a first barrier member according to any one of the preceding claims; and a second barrier member according to any one of the preceding claims, wherein a flexible barrier material of the first barrier member extends from the first barrier member to couple with a connection of the second barrier member.

The barrier may include a third barrier member, wherein a flexible barrier material of the second barrier member extends from the second barrier member to couple with a connection of the third barrier member.

According to one aspect, there is provided a method of using the barrier member, the method comprising: unwinding the flexible barrier material from the translatable column of the support and coupling it to the connection; and upon impact of the flexible barrier material above a first threshold, translating the translatable column from the first position to the second position, so the translatable column is engaged with the first engagement member to prevent rotation of the translatable column.

According to one aspect, there is provided a barrier assembly comprising: a first support member: a column having a longitudinal axis, the column rotatably mounted relative to the first support member such that it is rotatable around the longitudinal axis; a first engagement member coupled to the column; a second engagement member coupled to the first support member; the column being movably mounted to translate in a direction substantially perpendicular to the longitudinal axis, such that the column is moveable between: a first position in which the first engagement member and second engagement member are spaced apart from one another so that the shaft is rotatable around the longitudinal axis; and a second position, spaced apart from the first position, in which the first engagement member and second engagement member are brought onto engagement with one another to lock the column to the second engagement feature and/or first support member.

According to one aspect, there is provided a barrier comprising: a first support member comprising: a translatable column defining a longitudinal axis, wherein the translatable column is configured to rotate about said longitudinal axis and is translatable in a direction substantially perpendicular to the longitudinal axis from a first position to a second position; and one or more first engagement members configured to engage with the translatable column in the second position to prevent rotation of the column; and a flexible barrier material configured to extend from the translatable column and couple with a connection.

The above referenced features may be combined in various combinations.

BRIEF DESCRIPTION OF THE DRAWINGS

Examples of the present disclosure will now be described with reference to the accompanying drawings.

DETAILED DESCRIPTION

The present disclosure relates to a barrier that prevents vehicles from passing through. The barrier is arranged in such a way to provide a cushioned deceleration to a vehicle that may impact the barrier.

Figure 1A:
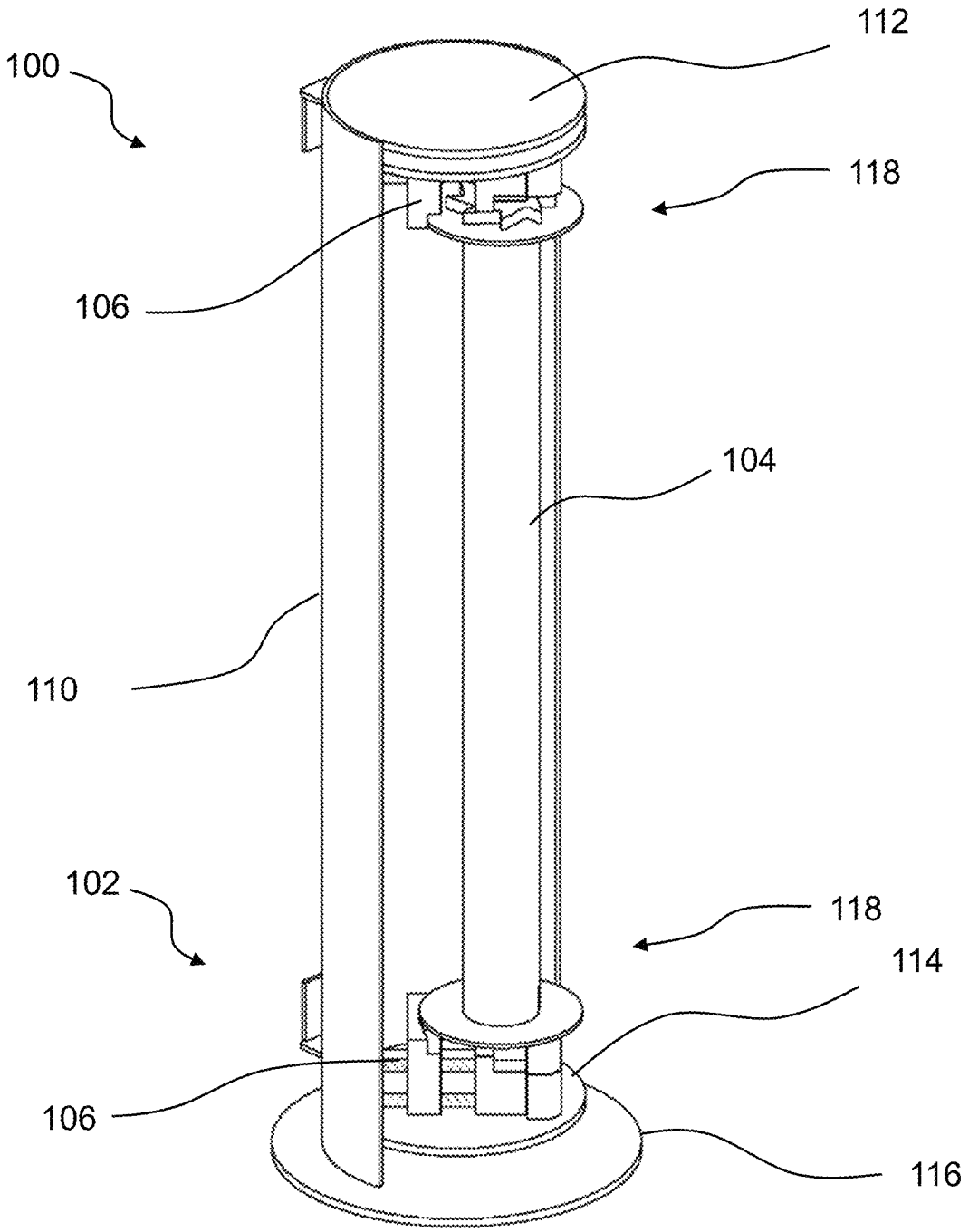
FIG. 1A shows a perspective view of a support in which the translatable column is shown in a first position.

FIG. 1A shows a perspective view of a barrier member 100. The barrier member 100 includes a support 102, a translatable column 104 and a first engagement member 106.

The support 102 may be substantially elongate and arranged in an upright orientation. In other words, the support 102 may be arranged in a vertical orientation. The support 102 is coupled with a translatable column 104. The translatable column 104 may be elongate and define a longitudinal axis about which the translatable column 104 is rotatable. In one example, the translatable column 104 is generally tubular. The components of the translatable column 104 are discussed in more detail below. The support 102 may include all the elements of the barrier member 100 except for the translatable column 104 and first engagement member 106.

The barrier member 100 includes the first engagement member 106 that is coupled with or mounted on the support 102. The first engagement member 106 is configured to engage with the translatable column 104 to prevent rotation of the translatable column 104 when the first engagement member 106 and the translatable column 104 are engaged. The first engagement member 104 may be known as a brake.

In FIG. 1A, the translatable column 104 is shown in a first position or neutral position in which it is not engaged with the first engagement member 106. That is to say that in the first position, the translatable column 104 is spaced apart from the first engagement member 106. In the absence of external forces, the translatable column 104 may be biased to the first position, as discussed in further detail below. In the first position, the translatable column 104 is free to rotate about its longitudinal axis. The translatable column 104 is movable (or translatable) between the first position, as shown in FIG. 1A, and a second position in which the translatable column 104 is engaged with the first engagement member 106. In the second position, the translatable column 104 is prevented from rotating about its longitudinal axis due to the interaction of the translatable column 104 and the first engagement member 106. The second position may be known as the engaged position.

In order to move between the first position and the second position, the translatable column 104 is configured to move in a direction that is substantially perpendicular or orthogonal to the longitudinal axis of the translatable column 104. That is to say that the translatable column 104 may both rotate about the longitudinal axis and translate in a linear direction in a direction substantially orthogonal to the longitudinal axis. The translatable column 104 may continue to rotate whilst concurrently translating. In other words, the translatable column 104 is rotatably and translatably mounted relative to the support 102.

The first engagement member 106 may exert a stopping force upon the translatable column 104 to prevent rotation, when the translatable column 104 is in the second position (i.e. when the translatable column 104 the first engagement member 106 are engaged). In one example, the first engagement member 106 comprises a notch or recess configured to receive a similarly shaped projection or tooth of the translatable column 104, such that when the projection is received in the notch of the first engagement member 106, the translatable column 104 is prevented from further rotation.

The barrier member 100 may include a flexible barrier material 108, which is not shown in FIG. 1A so that the translatable column 104 can be shown in detail.

Figure 1B:
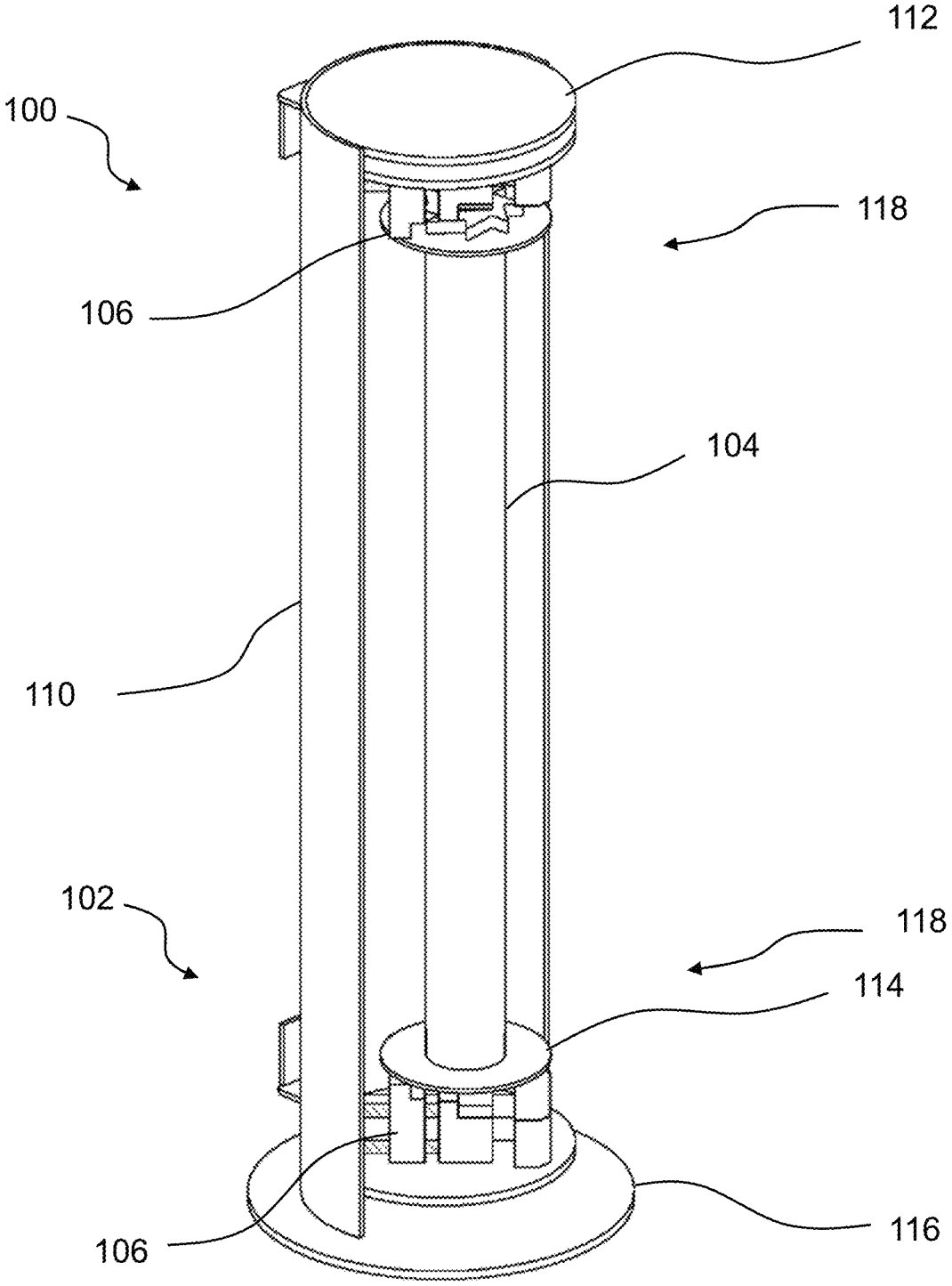
FIG. 1B shows a perspective view of the support in which the translatable column is shown in a second position.

FIG. 1B is identical to the arrangement shown in FIG. 1A, except that the translatable column 104 has moved from the first position as shown in FIG. 1A to the second position. In the second position, the translatable column 104 is engaged with or coupled with a first engagement member 106 of the support 102, which is discussed in more detail below.

As shown by comparing FIGS. 1A and 1B, the first position (shown in FIG. 1A) and the second position (shown in FIG. 1B) are spaced apart from one another.

Figure 1C:
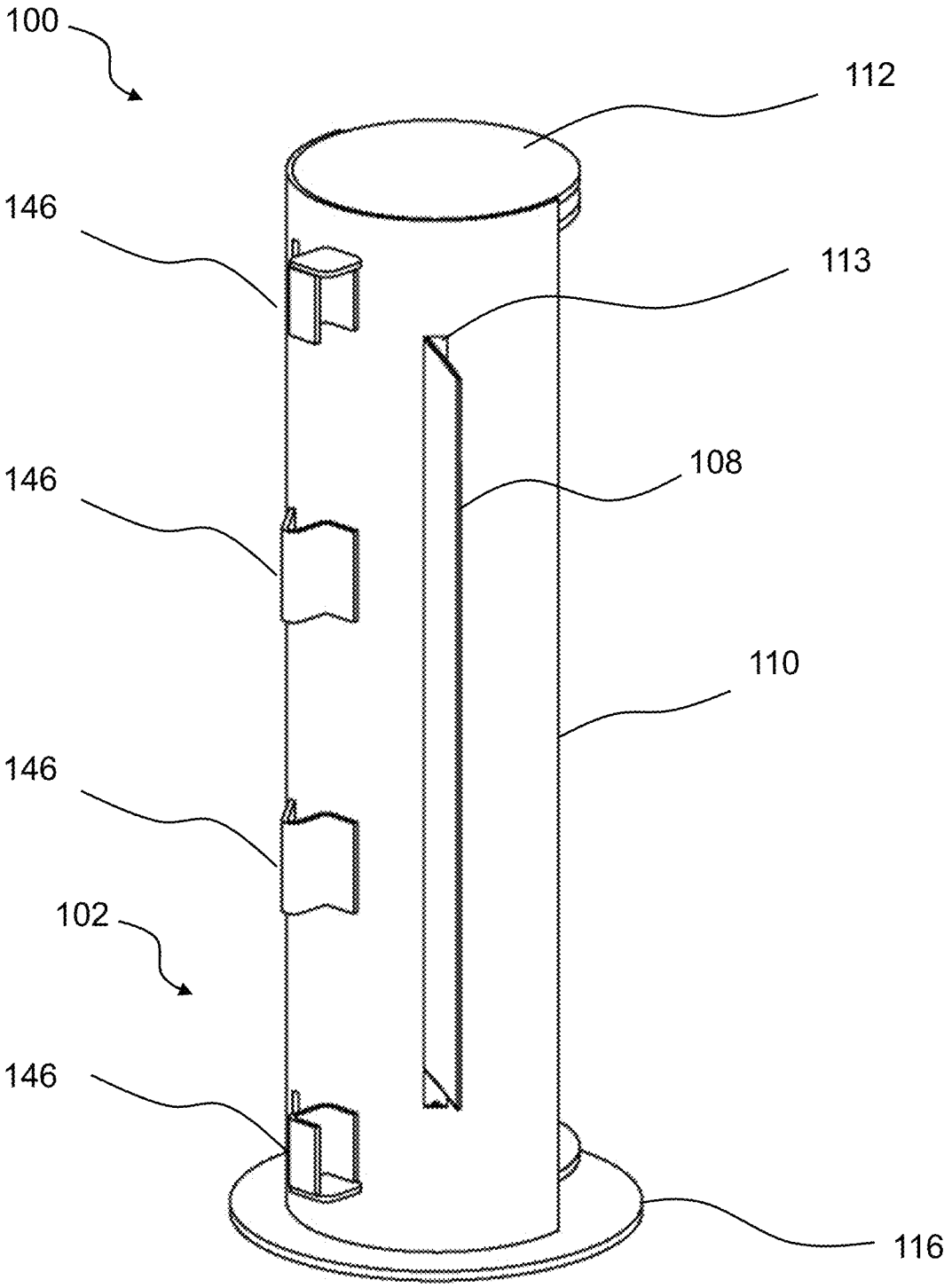
FIG. 1C shows a second perspective view of the support.

FIG. 1C shows a second perspective view of the barrier member 100. The flexible barrier material 108 is partially shown in FIG. 1C. The flexible barrier material 108 is configured to be at least partially wrapped around the translatable column 104 and is unwindable from the translatable column 104 in use. In other words, the flexible barrier material 108 may extend from the translatable column 104.

A free end of the flexible barrier material 108 is configured to couple with a connection to define the extent of the barrier.

As shown in FIGS. 1A, 1B and 1C, the support 102 may comprise a housing 110 configured to house the translatable column 104. In FIGS. 1A and 1B, a portion of the housing 110 is removed so the translatable column 104 is visible, but in practice, the housing 110 may extend entirely around the translatable column 104 to enclose the translatable column 104 therein. In the example shown, the housing 110 has a substantially circular cross-section, but other shapes are envisaged, such as a hexagonal cross section.

As shown in FIG. 1A, the housing 110 may comprise a top plate 112 and a bottom plate 114. The top plate 112 is arranged towards the top of the support 102 and closes off the top of the housing 110 in a vertical direction. The bottom plate 114 is arranged towards the bottom of the support 102.

The support 102 may comprise a base plate 116. The base plate 116 may include one or more holes through which fixtures (not shown) may extend to couple the support 102 to the ground. For example, the fixtures may be in the form of a dowel or bolt to fix the base plate 116 and therefore the support 102 in place. The fixtures and base plate 116 are configured to transfer impact forces from the flexible barrier material 108 to the ground, in use.

The housing 110 may comprise a slot 113 through which the flexible barrier material 108 may extend, as shown in FIG. 1C. The slot 113 may be substantially elongate and have a similar height to the height of the flexible barrier material 108.

The support 102 may comprise one or more biasing members configured to bias the translatable column 104 to the first position. The one of more biasing members may be compressible such that they are configured to compress as the translatable column 104 is moved from the first position to the second position. The one or more biasing members may comprise springs, hydraulic buffers, pistons, or a compressible material as will be discussed in more detail below. In one example, the one or more biasing members may comprise a plurality of magnets configured to bias the translatable column 104 to the first position.

In one example, the flexible barrier material 108 comprises attenuation stitching.

In FIG. 1A, a first movement mechanism 118 is shown towards the top of the support 102 and a second movement mechanism 118 is shown towards the bottom of the support 102. In other examples, only one movement mechanism 118 may be present and/or the movement mechanism 118 is provided at a position that is not towards either the first end or the second end of the support 102. The movement mechanism(s) 118 may be considered to be part of the support 104.

Figure 2A:
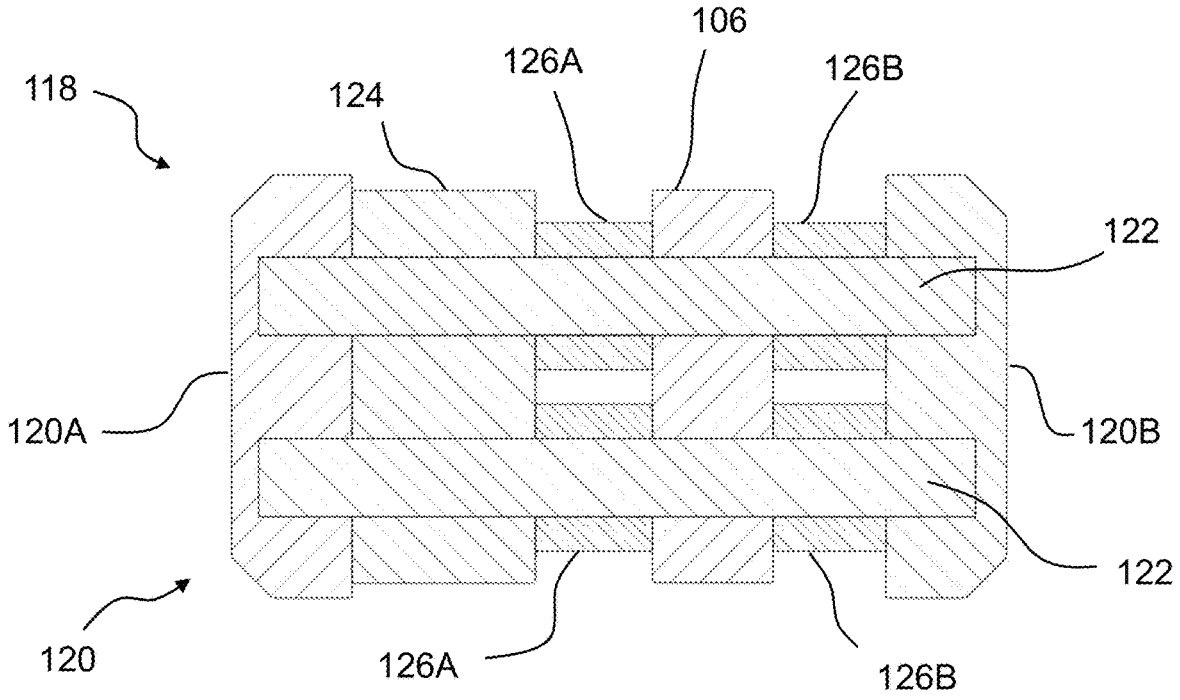
FIG. 2A shows a cross-section of the movement mechanism in a first plane.

FIG. 2A shows a cross-section of the movement mechanism 118. The movement mechanism 118 may comprise a first end member 120A and a second end member 120B that are separated to define a gap therebetween. The movement mechanism 118 may abut the bottom plate 114 or the top plate 112. In the example of a movement mechanism 118 being located at the bottom of the support 102, the movement mechanism 118 may be supported directly the bottom plate 114.

The movement mechanism 118 includes the one or more biasing members configured to bias the translatable column 104 to the first position.

One or more guiderails 122 are configured to extend between the first and second end members 120A, 120B. The guiderails 122 may be received within a recess of the first and second end members 120A, 120B to fix the guiderails 122 relative to the first and second end members 120A, 120B. In the example shown in FIG. 2, the movement mechanism 118 includes two guiderails 122 located between the first end member 120A and the second end member 120B. In one example, the guiderails 122 are cylindrical or tubular, but other shapes are envisaged. In this example, the guiderails 122 are arranged in parallel.

The translatable column 104 may be mounted on the guiderails 122 via a column attachment block 124. The column attachment block 124 may be integral with the translatable column 104 or be a separate connected element. The column attachment block 124 is configured to be received on one or more guiderails 122. In other words, the column attachment block 124 may include one or more through holes through which the one or more guiderails 122 is configured to extend through, in use. The through holes of the column attachment block 124 may be configured to substantially match the cross-sectional shape of the guiderails 122. In other words, the column attachment block 124 may have a snug fit on the guiderails, but with enough tolerance to allow the column attachment block 124 to move along the guiderails 122 in use, with relatively low friction.

The first engagement member 106 may be mounted on the guiderails 122. In other words, the first engagement member 106 may be mounted on the support 102. The first engagement member 106 may also comprise one or more through holes to receive the guiderails 122. The through holes of the first engagement member 106 may also be complimentary in shape to the cross-sectional shape of the guiderails 122 so the first engagement member 106 has a snug fit on the guiderails 122, but with enough tolerance to allow the first engagement member 106 to move along the guiderails 122 in use, with relatively low friction.

The movement mechanism 118 may include one or more springs 126A, 126B. That is to say that the one or more biasing members is one or more springs 126A, 126B. The springs 126A, 126B are located around (or on) the guiderails 122. That is to say that the springs 126A, 126B may substantially surround the guiderails 122, in use. In the example shown in FIG. 2A, a first spring 126A is located between the first engagement member 106 and the column attachment block 124. The first spring 126A may abut and/or be attached to the first engagement member 106 at a first end and may abut and/or be attached to the column attachment block 124 at a second end. The second spring 126B is located between a second end member 120B and the first engagement member 106. The second spring 126B may abut and/or be attached to the first engagement member 106 at a first end and may abut and/or be attached to the second end member at a second end.

The one or more springs 126A, 126B are configured to bias the column attachment block 124, and hence the translatable column 104, in a first position. In the first position, the column attachment block 124 may abut the first end member 120B.

Figure 2B:
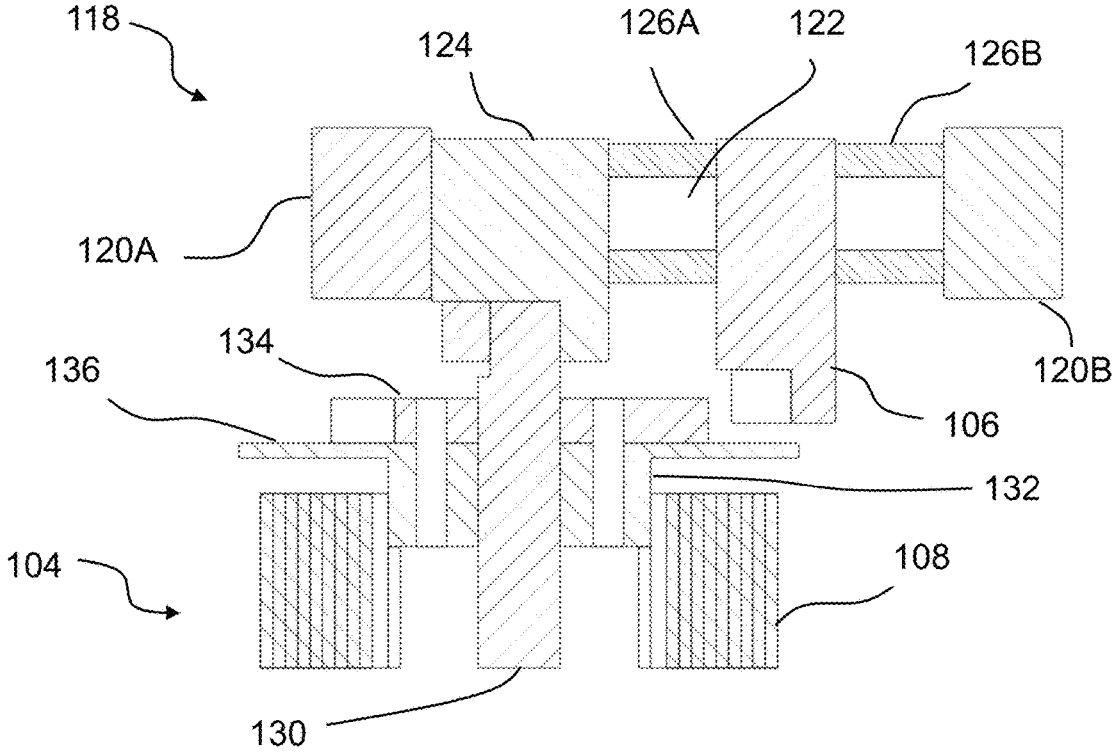
FIG. 2B shows a cross-section through the movement mechanism in a second plane in which the translatable column is in a first position.

FIG. 2B shows a cross section through the movement mechanism 118 at a top of the support 102. In this example, the translatable column 104 is shown in the first position (or neutral position). That is to say that the translatable column 104 is not engaged with the first engagement member 106. In the first position, the column attachment block 124 may abut the first end member 120A.

FIG. 2B shows the elements of the translatable column 104 in more detail. In one example, the translatable column 104 may include an inner shaft 130 and an outer shaft 132. The inner shaft 130 may be in the form of a tubular rod and is the part of the translatable column 104 that is coupled with the column attachment block 124. The inner shaft 130 may be received within a recess of the column attachment block 124 and be fixed therein by one or more fixtures (not shown). The inner shaft 130 may not rotate in use. In contrast, the inner shaft 130 may be coupled to the column attachment block 124 via one or more bearings and may also be configured to rotate in use.

The outer shaft 132 may be substantially hollow and elongate and is configured to extend around the inner shaft 130. The outer shaft 132 may be coupled to the inner shaft 130 via one or more bearings. FIG. 2B shows that the flexible barrier material 108 may be wrapped around the outer shaft 132 of the translatable column 104. In this example, the flexible barrier material 108 may be attached to the translatable column 104 via a loop of flexible barrier material 108 that extends around the translatable column 104 and couples to itself.

The translatable column 104 may include one or more second engagement members 134. The one or more second engagement members 134 are configured be in a fixed relationship relative to the outer shaft 132. That is to say that the second engagement members 134 may rotate together with the outer shaft 132 when the translatable column 104 is in the first (neutral) position. The second engagement member 134 is shown in more detail in FIG. 5 and is discussed more in the description of FIG. 5. The translatable column 104 may also include a second engagement member plate 136, which caps the outer shaft 132. In other words, the second engagement member plate 136 is configured to abut the outer shaft 132. In some examples the second engagement member 134 is an integral part of the translatable column 104.

A cap 138 may be located within the region between the outer shaft 132 and the inner shaft 130. The cap 138 may have a press fit relative to the outer shaft 132 and/or be attached the other outer shaft 132 via an adhesive. The second engagement member 134, second engagement member plate 136 and cap 138 may have co-located openings through which one or more fixtures, such as dowels, can extend to couple the second engagement member 134 and second engagement member plate 136 to the cap 138 (and hence the outer shaft 132).

The detail shown in FIG. 2B shows the arrangement of the top of the translatable column 104 coupled to a movement mechanism 118 at the top of the support 102. A "mirrored" version of the movement mechanism 118 may be present at the bottom of the support 102, in which case the movement mechanism 118 would be below the translatable column 104. That is to say that the inner shaft 130 of the translatable column 104 would couple with a column attachment block 124 that is below the inner shaft 130.

FIG. 2B shows an example in which the biasing member comprises a first spring 126A and a second spring 126B. The first spring 126A and the second spring 126B are configured to bias the column attachment block 124, and hence the translatable column 104, to a first position in which the translatable column 104 is rotatable about its longitudinal axis. In this example, the first spring 126A and the second spring 126B are arranged in series (and there is also a second arrangement of a first spring 126A and second spring 126B arranged in parallel with the first arrangement of the first spring 126A and second spring 126B).

The first spring 126A and the second spring 126B may have different spring stiffnesses. for example, the first spring 126A may have a first spring stiffness and the second spring may have a second spring stiffness, different to the first. This arrangement means that upon the application of a force to compress the springs, the first spring 126A and the second spring 126B are configured to be compressed at different rates and by different amounts.

Figure 3:
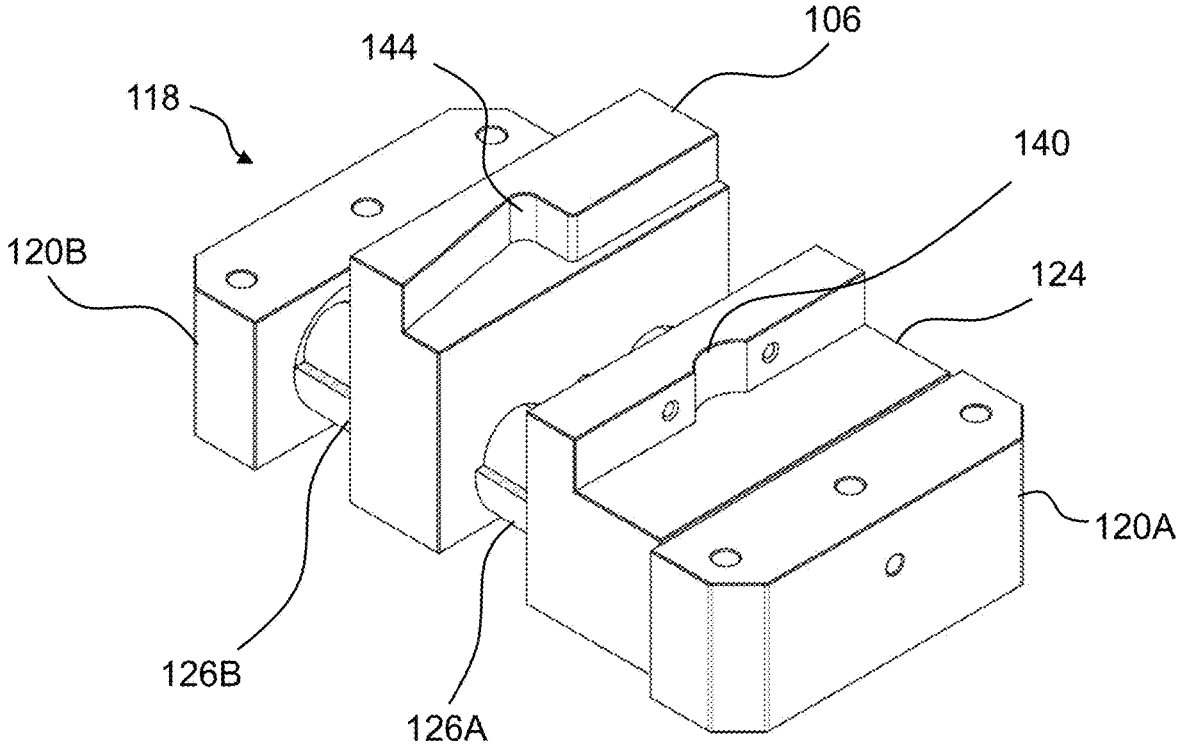
FIG. 3 shows a perspective view of the movement mechanism.

FIG. 3 shows a perspective view of a movement mechanism 118 with the first engagement member 106 and the column attachment block 124 mounted thereon. The example of the movement mechanism 118 shown in FIG. 3 may be located at the bottom of the support 102. The column attachment block 124 may include a recess configured to receive at least part of the inner shaft 130 of the translatable column 104. The first engagement member 106 is also shown in detail in FIG. 3. The first engagement member 106 may include a shaped recess 144 that is suitable for receiving all or part of a component of the translatable column 104. In one example, a projection or tooth 140 of a second engagement member 134 (as shown in more detail in FIG. 5), is configured to be shaped so as to be received in the recess 144 to engage the translatable column 104 with the first engagement member 106. The first engagement member 106 and second engagement member 134 are shaped such that the first engagement member 106 is configured to prevent further rotation of the second engagement member 134 as the second engagement member 134 is engaged with the first engagement member 106. The first engagement member 106 and second engagement member 134 may have a complimentary shape. In other words, a projection or tooth 140 of a second engagement member is configured to be received within the recess 144 of said first engagement member 106 and provide a restraining force upon said tooth 140 and second engagement member 134.

Figure 4:
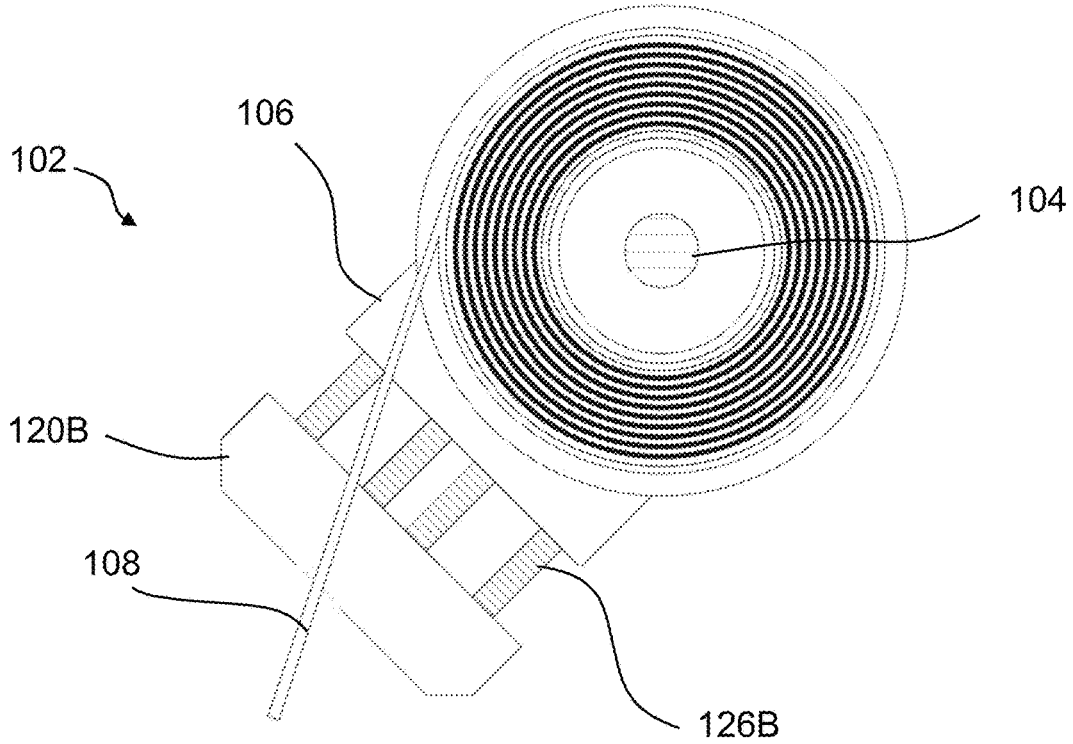
FIG. 4 shows a cross-sectional view through the support.

FIG. 4 shows a cross-sectional view through the support 102. A movement mechanism 118 is shown located towards the bottom of the support 102. The flexible barrier material 108 is shown in this example as being wrapped around the translatable column 104 and extending through slot 113 of the housing 110. In this case the flexible barrier material 108 is wrapped around the outer shaft 132 of the translatable column 104 and occludes part of the movement mechanism 118 from view.

Figure 5:
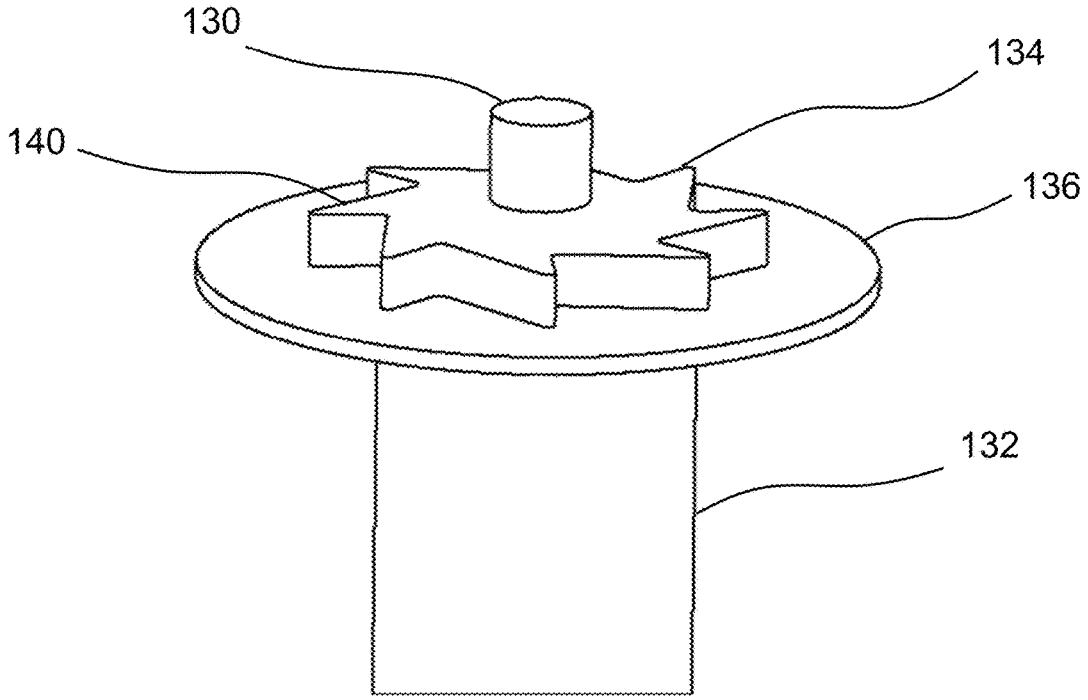
FIG. 5 shows a view of a second engagement member.

FIG. 5 shows a view of a second engagement member 134 located at the top of the translatable column 104. The second engagement member 134 is part of the translatable column 104. In this example, the second engagement member 134 comprises a plurality of projections 140. In the example shown in FIG. 5, the projections (or teeth) 140 are configured to project from a central point of the second engagement member at an acute angle relative to the central point of the second engagement member 134. Other arrangements of projections 140 are envisaged.

In other examples, the translatable column 104 does not include a second engagement member 134 at all. Instead the first engagement member 106 comprises one or more surfaces configured to engage with the translatable column 104 in the second position and impart a friction upon the translatable column 104 so as to prevent further rotation of the translatable column 104.

Figure 6A:
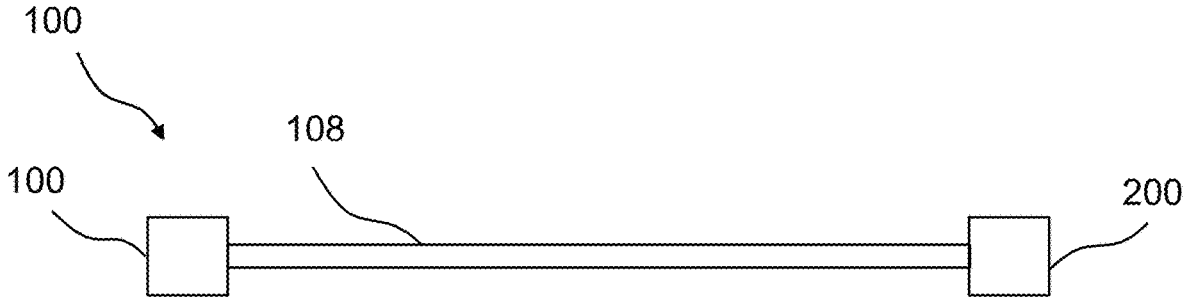
FIG. 6A shows a schematic example of a system showing a support, a second support member and the flexible barrier material extending therebetween.

FIG. 6A shows a schematic example of a system showing the first barrier member 100, a second barrier member 200 and the flexible barrier material 108 extending therebetween. In FIG. 6A, at least part of the flexible barrier material 108 extends from the first barrier member 100 and is coupled with the second barrier member 200. There may still a portion of the flexible barrier material 108 that is still wrapped around the translatable column 104.

A free end of the flexible barrier material 108 may be received in a connection. For example, the free end of the flexible barrier material 108 may be received in one or more hooks 246 of the second barrier member 200 (which may be identical to the hooks 146 shown on the first barrier member 100 in FIG. 1B).

In the configuration shown in FIG. 6A, i.e. without there may any external force (such as an impact force) on the flexible member 108, the translatable column 104 is arranged in the first position (e.g. the neutral position), as shown in FIGS. 1A, 2A and 2B. The one or more biasing members, such as springs, may bias the translatable column 104 to the first position.

Figure 6B:
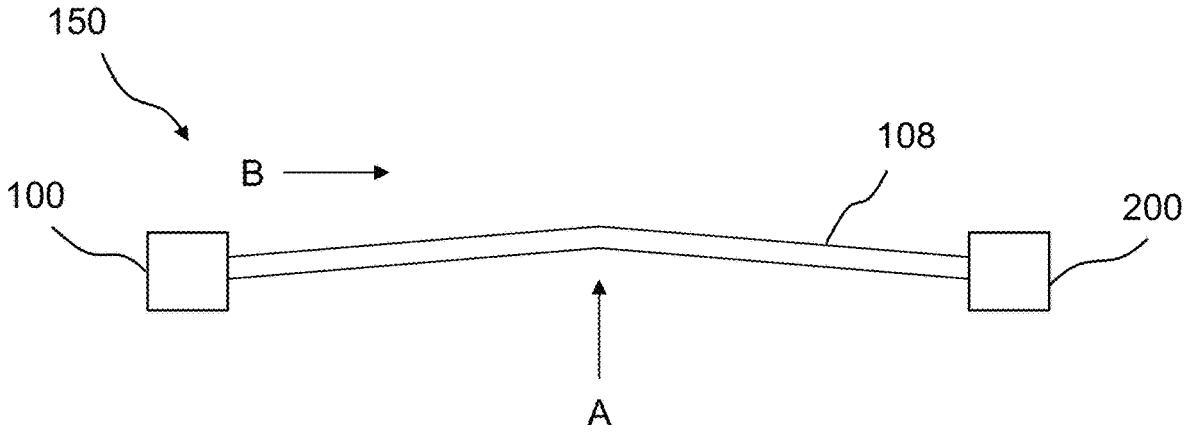
FIG. 6B shows a schematic example of the deflection of the flexible barrier material due to an impact force.

FIG. 6B shows an example of the deflection of the flexible barrier material 108 due to an impact force, represented by arrow A, on the flexible barrier material 108. The impact force is shown by the arrow A in the middle of the flexible barrier material 108, but may be located anywhere on the flexible barrier material in practice (i.e. not necessarily in the middle). The impact force could be generated by a vehicle impact on the flexible barrier material 108. The end of the flexible barrier material 108 that is coupled to the connection point on the second barrier member 200 is fixed so would not move in practice during the impact. However, the impact force would impart a force through the flexible barrier material 108 to the translatable column 104 of the first barrier member 100. The force will then be transferred through the translatable column 104 to the column attachment block 124 on the guiderail(s) 122. The force will then act against the biasing force provided by the one or more biasing members.

Depending on the level of the impact force, the resultant force on the column attachment block 124 may be sufficient to overcome the bias force provided by the one or more biasing members (such as the first and second springs 126A, 126B). That is to say that the column attachment block 124 moves to compress the one or more first springs 126A and the one or more second spring 126B.

If the impact force is sufficient, the column attachment block 124 will move relative to the first engagement member 106 along the guiderails 122. If the impact force is sufficiently high enough, the translatable column 104 engages with the first engagement member 106 so as to prevent further rotation of the translatable column 104, thereby preventing more of the flexible barrier material 108 from unwinding from the translatable column 104. The translatable column 104 is in the second position when it is engaged with the first engagement member 106. In the example in which the one or more biasing members comprises one or more springs, in this phase then one or more first springs 126A will compress and the column attachment block 124 will move relative to the first engagement member 106 along the guiderails 122.

As described above, in one example, the second engagement member 134 of the translatable column 104 is configured to mesh with or engage with the recess 144 of the first engagement member 106 to prevent further rotation of the translatable column 104.

The barrier member 100 is configured such that in a first mode of operation, the translatable column 104 is operable to rotate around the longitudinal axis in a first rotational direction to wind the flexible barrier material 108 onto the column 104. In the first mode of operation, the translatable column 104 is arranged in a first position in which the translatable column and the first engagement member 106 are spaced apart.

In a second mode of operation, the translatable column 104 is operable to rotate around the longitudinal axis in a second rotational direction to unwind the flexible barrier material 108 from the column 104. The second rotational direction is opposite to the first rotational direction.

In a third mode of operation, the translatable column 104 is operable to move from the first position to the second position.

The barrier member is configured to switch between the second mode of operation and the third mode of operation if an impact force on the flexible barrier material 108 is above a first threshold value.

The first threshold value may be defined by the biasing force provided by the one or more biasing members. In the example of the one or more biasing members comprising one or more springs 126A, 126B, the first threshold value would be set by the force required to compress the one or more first spring 126 such that the translatable column moves from the first position to the second position (i.e. the one or more first springs is compressed by a sufficient amount).

Figure 7A:
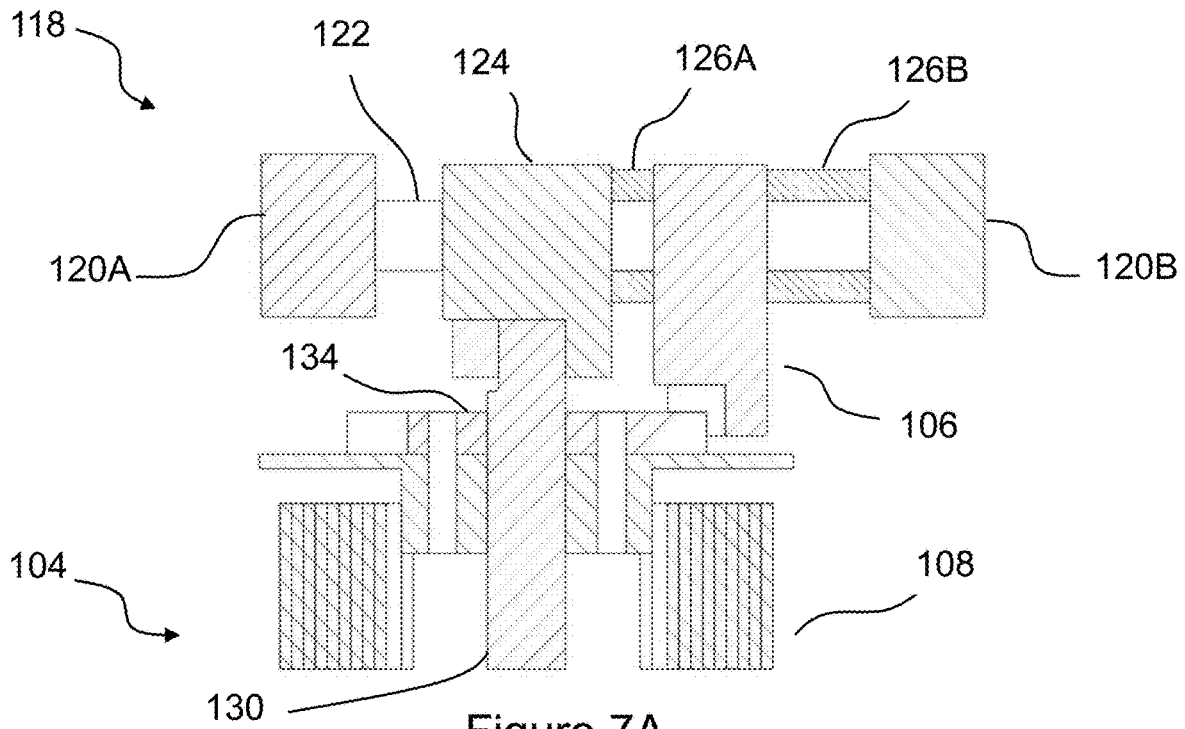
FIG. 7A shows a cross-section through the movement mechanism in which the translatable column is in a second position.

FIG. 7A shows a cross-section of the movement mechanism 118 and part of the translatable column 104 in the second position. FIG. 7A is similar to FIG. 2B, except that the column attachment block 124 and the translatable column 104 have move from the first position to the second position in which the translatable column 104 is engaged with the first engagement member 106. In other words, the biasing force provided by the one or more first biasing members (e.g. one or more first springs 126A) has been overcome.

If the impact force is sufficiently high, then after the engagement of the translatable column 104 and the first engagement member 106, further compression of the one or more second biasing members (for example, the one or more second springs 126B) may occur and the translatable column 104 and the first engagement member 106 may move together along the guiderails 122 against the bias of the one or more second biasing members 126B.

As described above, the spring stiffness of the one or more first springs 126A is configured to be different compared with the spring stiffness of the one or more second springs 126B. In one example, the spring stiffness of the one or more first springs 126A is configured to be lower compared with the spring stiffness of the one or more second springs 126B.

The first spring 126A and the second spring 126B may be arranged in a series relationship on each guiderail 122. The deformation of each spring is governed by the following formula: $k1\times1=k2\times2$.

As such, setting the spring stiffness of the one or more first springs 126A to a lower value compared with the one or more second springs 126B means that under the application of force, the one or more first springs 126A is configured to compress by a great amount compared with the one or more second springs 126B.

The presence of the one or more second springs 126B with a higher stiffness provides a dampening effect on the movement of the translatable column 104. That is to say that even after the translatable column 104 has engaged with the first engagement member 106, the first engagement member 106 and translatable column 104 may continue to move together.

Figure 7B:
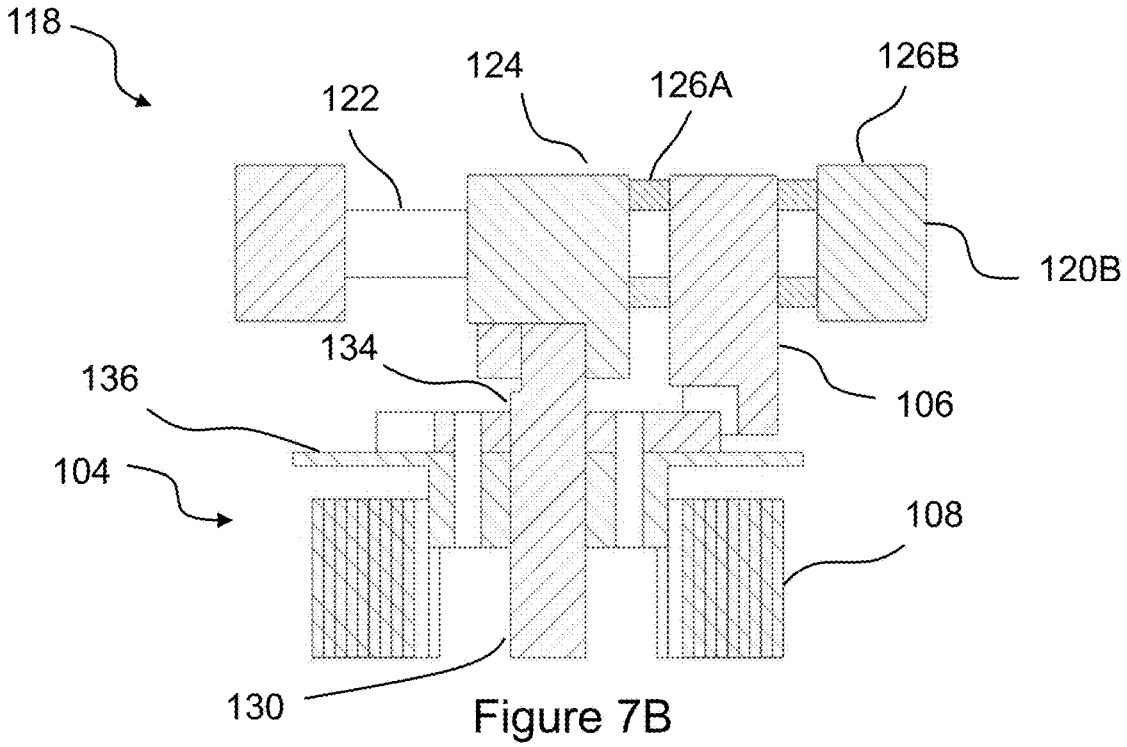
FIG. 7B shows a cross-section through the movement mechanism in which the translatable column is engaged with the first engagement member.

FIG. 7B shows a cross-section of the movement mechanism 118 and part of the translatable column 104. In this third position, the translatable column 104 and the first engagement member 106 are engaged and have moved together against the bias of the one or more second biasing members (such as the one or more second springs 126B). The one or more second biasing members springs 126B acts as a further cushion against the movement of the translatable column 104. That is to say, that upon impact of the flexible barrier material 108, the combination of the one or more first biasing members and the one or more second biasing members (e.g. the one or more first springs 126A and the one or more second springs 126B) act to safely decelerate and stop the cause of the impact.

Figure 8:
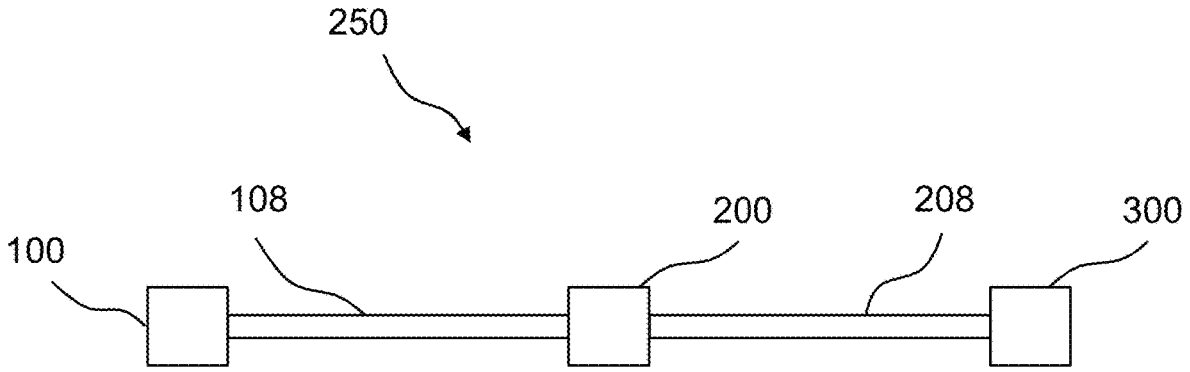
FIG. 8 shows a schematic example of a system showing a support, a second support member and a third member with a first flexible member extending between the support and second support member and a second flexible barrier material extending between the second support member and the third support member.

FIG. 8 shows an example of a barrier comprising a first barrier member 100, a second barrier member 200 and a third barrier member 300. The operation of the translatable column 104 coupled to the support 102 is identical to how it is described above, but in this case, the second barrier member 200 also includes a translatable column and all of the other components described above. In other words, the system may be modular such that the barrier members 100, 200, 300 including a support member 102, translatable column 104 and engagement member 106 arranged in the fashion described above, may be provided in a repeating pattern. In other words, the barrier members 100 may be modular.

In other examples, the springs 126A, 126B may be replaced by other biasing members. For example, one or more hydraulic buffers may be used in place of the one or more springs. The hydraulic buffers may be used in conjunction with the guiderails 122 or replace the guiderails. As with the springs, a first hydraulic buffer may replace the first spring and a second hydraulic buffer may replace the second spring. The first hydraulic spring and second hydraulic buffer may have different response characteristics. That is to say that the first hydraulic buffer may compress easier compared with the second hydraulic buffer.

In another example, the one or more springs 126A, 126B may be replaced by a compressible material, such as polyurethane (PU). The PU material is configured to compress upon the application of load, but return to its original shape once the load has been removed. As with the springs, a first compressible material may replace the first spring and a second compressible material may replace the second spring. The first compressible material and second compressible material may have different Young's Modulus values. That is to say that the first compressible material may compress easier compared with the second compressible material.

In another example, the one or more springs 126A, 126B may be replaced by a plurality of magnets. That is to say that a first magnet may be placed on the column attachment block 124 and a second magnet may be place on the first engagement member 106. The first and second magnets are arranged such that the same polarity face each other so the resistive force increases as the column attachment block 124 moves closer to the first engagement member 106. A third magnet may be arranged on the other side of the first engagement member 106 and a fourth magnet may be arranged on the second end member 120B. The polarity of the third and fourth magnets that face each other are configured to match.

Figure 9:
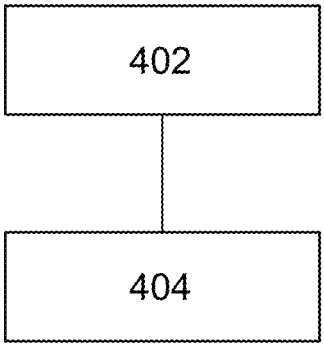
FIG. 9 shows a process for method steps for using the barrier to stop a vehicle in use.

FIG. 9 shows a flow diagram of the method steps of using a barrier member 100. Step 402 represents unwinding 108 the flexible barrier material from the translatable column 104 of the first barrier member and coupling it to the connection. Step 404 represents translating the translatable column 104 from a first position to a second position, upon impact of the flexible barrier material 108, so the translatable column 104 is engaged with the first engagement member 106 to prevent further rotation of the translatable column 104.

In one example, the first engagement member 106 is configured to be located within the outer shaft 132 of the translatable column 104 itself. The operation of the translatable column 104 and barrier member is as described above, i.e. the outer shaft 132 of the translatable column 104 is translatable between a first position in which the outer shaft 132 of the translatable spindle column and the first engagement member 106 are spaced apart from one another such that the outer shaft 132 of the translatable column 104 is rotatable about said longitudinal axis; and a second position in which the outer shaft 132 of the translatable column 104 and the first engagement member 106 are engaged to prevent rotation of the outer shaft 132 of the translatable column 104 about said longitudinal axis.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. A barrier member comprising:

a support;

a first engagement member coupled to the support; and a translatable column defining a longitudinal axis, wherein the translatable column is rotatably and translatably mounted relative to the support;

the translatable column is translatable between:

a first position in which the translatable column and the first engagement member are spaced apart from one another such that the translatable column is rotatable about the longitudinal axis, and a second position in which the translatable column and the first engagement member are engaged to prevent rotation of the translatable column about the longitudinal axis;

the barrier member comprises one or more biasing members configured to bias the translatable column to the first position;

the support comprises a first movement mechanism defining an extent of translation of the translatable column, the first movement mechanism comprising a first end member and a second end member and the one or more biasing members;

the one or more biasing members are located between the first end member and the second end member;

the first movement mechanism comprises one or more guiderails extending between the first end member and the second end member of the first movement mechanism; and the translatable column is coupled to the one or more guiderails via a column attachment block.

2. The barrier member according to claim 1, wherein the translatable column comprises a second engagement member having a complimentary shape with the first engagement member, such that in the second position, the second engagement member is configured to engage with the first engagement member to prevent rotation of the translatable column.

3. The barrier member according to claim 1, wherein the one or more biasing members is configured to compress as the translatable column is moved from the first position to the second position.

4. The barrier member according to claim 1, wherein the one or more biasing members comprises a compressible elastic material.

5. The barrier member according to claim 1, wherein the one or more biasing members comprises a plurality of magnets configured to bias the translatable column to the first position.

6. The barrier member according to claim 1, comprising:

a flexible barrier material that extends from the translatable column in a direction substantially perpendicular to the longitudinal axis and is configured to be coupled to a connection point, wherein the barrier member is configured such that:

in a first mode of operation, the translatable column is operable to rotate around the longitudinal axis in a first rotational direction to wind the flexible barrier material onto the translatable column, in a second mode of operation, the translatable column is operable to rotate around the longitudinal axis in a second rotational direction to unwind the flexible barrier material from the translatable column, and in a third mode of operation, the translatable column is operable to move from the first position to the second position, the support comprises a housing configured to house the translatable column and first engagement member, wherein the housing comprises a slot through which the flexible barrier material is configured to extend, the first end member of the first movement mechanism is coupled with an inner surface of the housing at a first location and the second end member of the first movement mechanism is coupled with an inner surface of the housing at a second location, and the first location and second location are diametrically opposed on the housing.

7. The barrier member according to claim 1, wherein the support comprises a second movement mechanism, wherein the first movement mechanism and second movement mechanism are arranged at opposite ends of the support.

8. The barrier member according to claim 1, comprising:

a flexible barrier material that extends from the translatable column in a direction substantially perpendicular to the longitudinal axis and is configured to be coupled to a connection point.

9. The barrier member according to claim 8, wherein the barrier member is configured such that:

in a first mode of operation, the translatable column is operable to rotate around the longitudinal axis in a first rotational direction to wind the flexible barrier material onto the translatable column; and in a second mode of operation, the translatable column is operable to rotate around the longitudinal axis in a second rotational direction to unwind the flexible barrier material from the translatable column; and in a third mode of operation, the translatable column is operable to move from the first position to the second position.

10. The barrier member according to claim 9, wherein the barrier member is configured to switch between the second mode of operation and the third mode of operation if an impact force on the flexible barrier material is above a first threshold value.

11. The barrier member according to claim 9, wherein the support comprises a housing configured to house the translatable column and first engagement member, wherein the housing comprises a slot through which the flexible barrier material is configured to extend.

12. A method of using the barrier member according to claim 8, the method comprising:

unwinding the flexible barrier material from the translatable column of the barrier member and coupling it to the connection point; and upon impact of the flexible barrier material above a first threshold, translating the translatable column from the first position to the second position, so the translatable column is engaged with the first engagement member to prevent rotation of the translatable column.

13. The barrier member according to claim 1, wherein the one or more biasing members comprises one or more hydraulic buffers.

14. The barrier member according to claim 13, wherein the one or more hydraulic buffers comprises one or more first hydraulic buffers having a first load response characteristic and one or more second hydraulic buffers having a second, different load response characteristic arranged in series.

15. The barrier member according to claim 1, wherein the one or more biasing members comprise one or more springs.

16. The barrier member according to claim 15, wherein the one or more springs comprises one or more first springs having a first stiffness and one or more second springs having a second, different stiffness arranged in series.

17. The barrier member according to claim 1, wherein the first engagement member is coupled to the one or more guiderails.

18. The barrier member according to claim 17, wherein the one or more biasing members comprise one or more first springs having a first stiffness and one or more second springs having a second, different stiffness arranged in series, and wherein the one or more first springs is located between the first engagement member and the column attachment block and the one or more second springs is located between a second end member of the first movement mechanism and the first engagement member.

19. The barrier member according to claim 18, wherein the one or more second springs comprises a higher stiffness than the one or more first springs.

20. A barrier comprising:

a first barrier member according to claim 1; and a second barrier member, wherein a flexible barrier material of the first barrier member extends from the first barrier member to couple with a connection of the second barrier member.

21. The barrier according to claim 20, comprising a third barrier member, wherein a flexible barrier material of the second barrier member extends from the second barrier member to couple with a connection of the third barrier member.

* * * * *